US011319778B2

(12) United States Patent
Howitt

(10) Patent No.: US 11,319,778 B2
(45) Date of Patent: May 3, 2022

(54) DRILLABLE CASING SCRAPER

(71) Applicant: HALLIBURTON ENERGY SERVICES, INC., Houston, TX (US)

(72) Inventor: Garry Martin Howitt, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 114 days.

(21) Appl. No.: 16/957,985

(22) PCT Filed: Sep. 28, 2018

(86) PCT No.: PCT/US2018/053318
§ 371 (c)(1),
(2) Date: Jun. 25, 2020

(87) PCT Pub. No.: WO2020/068103
PCT Pub. Date: Apr. 2, 2020

(65) Prior Publication Data

US 2020/0332625 A1 Oct. 22, 2020

(51) Int. Cl.
*E21B 37/02* (2006.01)

(52) U.S. Cl.
CPC ..... *E21B 37/02* (2013.01)

(58) Field of Classification Search
CPC ..... E21B 12/06; E21B 17/006; E21B 37/02; E21B 37/04; E21B 49/06
See application file for complete search history.

(56) References Cited

U.S. PATENT DOCUMENTS 3,105,555 A * 10/1963 Villalon, Jr. ..... E21B 37/02 166/174
4,798,246 A * 1/1989 Best ..... B08B 9/0436 134/23
6,745,839 B1 6/2004 Simpson
(Continued)

FOREIGN PATENT DOCUMENTS

WO WO 2015/012999 1/2015

OTHER PUBLICATIONS

International Search Report and Written Opinion from International Application No. PCT/US2018/053318, dated Jun. 26, 2019, ISA/KR, 12 pages.

(Continued)

*Primary Examiner* — Robert E Fuller
*Assistant Examiner* — Lamia Quaim
(74) *Attorney, Agent, or Firm* — Haynes and Boone, LLP

(57) ABSTRACT

An apparatus, system, and method according to which debris is cleaned from a casing that extends within a wellbore. The method generally includes running a downhole tool into the casing, the downhole tool comprising an isolation tool, a setting tool, and a casing scraper. Debris is then cleaned from an inner surface of the casing at a depth interval using the casing scraper. After cleaning the debris from the inner surface of the casing, the isolation tool is set against the inner surface of the casing at the depth interval using the setting tool to isolate a zone of the wellbore. After setting the isolation tool against the inner surface of the casing, a wellbore operation is performed in which isolation of the zone of the wellbore is required. The downhole tool is then drilled out of the casing using a drill bit.

20 Claims, 9 Drawing Sheets

(56) References Cited

U.S. PATENT DOCUMENTS

| | | | |
|---|---|---|---|
| 7,121,343 | B2 | 10/2006 | Telfer |
| 7,311,141 | B2 | 12/2007 | Tulloch et al. |
| 8,002,037 | B2 | 8/2011 | Booth |
| 9,512,696 | B2 | 12/2016 | Penisson |
| 2001/0040035 | A1 | 11/2001 | Appleton et al. |
| 2009/0272524 | A1 | 11/2009 | Voth |
| 2010/0186962 | A1 | 7/2010 | Knobloch et al. |
| 2017/0362917 | A1 | 12/2017 | Esslemont et al. |

OTHER PUBLICATIONS

Casing Scraper, M&M OilTools, 1 page.

* cited by examiner

DRILLABLE CASING SCRAPER

CROSS-REFERENCE TO RELATED APPLICATION

The present application is a U.S. National Stage patent application of International Patent Application No. PCT/US2018/053318, filed on Sep. 28, 2019, the benefit of which is claimed and the disclosure of which is incorporated herein by reference in its entirety.

TECHNICAL FIELD

The present disclosure relates generally to wellbore casing scrapers, and, more particularly, to a drillable casing scraper for removing debris from an inner surface of a wellbore casing.

BACKGROUND

Many wellbore drilling, completion, and/or production operations in the oil and gas industry require isolation of a particular zone within a wellbore to achieve a desired result. However, multiple trips are often required to effectively isolate the particular zone, to perform the wellbore operation, and to subsequently carry on another wellbore operation. For example, a trip may be required to set the isolation tool in a casing extending within the wellbore at a depth interval so that the particular zone requiring isolation for execution of the wellbore operation is isolated. Another trip may be required to complete the wellbore operation. Yet another trip may be required to remove the isolation tool. Still another trip may be required to subsequently carry on another wellbore operation. Moreover, depending on the characteristics of the wellbore and the casing, one or more additional trips may be necessary to clean the casing at the depth interval before the isolation tool is set at the depth interval to ensure an effective seal between the isolation tool and the casing. It would therefore be desirable to reduce the number of trips required to effectively isolate the particular zone, to perform the wellbore operation, and to subsequently carry on another wellbore operation. Therefore, what is needed is an apparatus, system, and/or method that addresses one or more of the foregoing issues, and/or one or more other issues.

DETAILED DESCRIPTION

Figure 1:
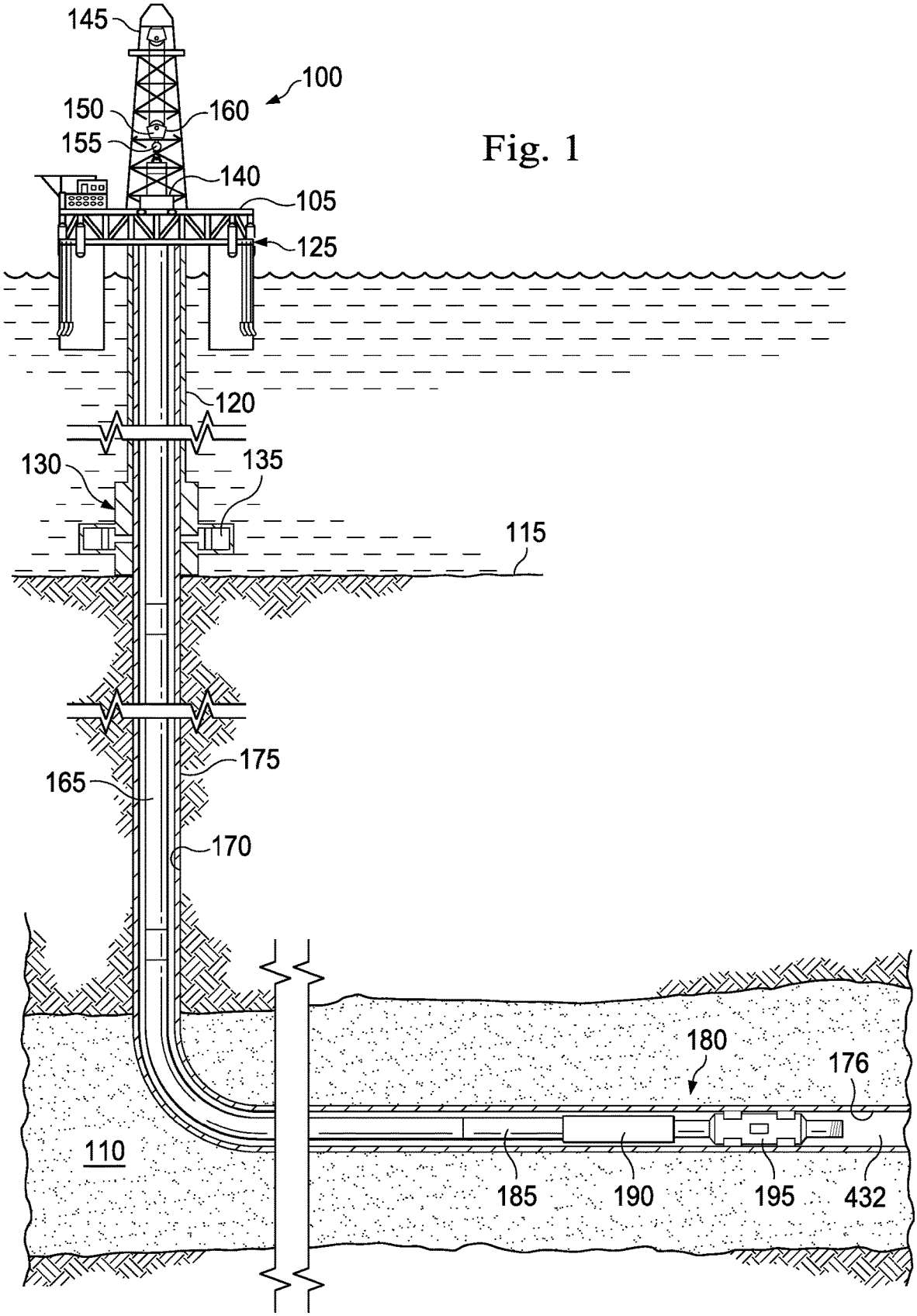
FIG. 1 is an elevational view of an offshore oil and gas platform operably coupled to a downhole tool extending within a wellbore, according to one or more embodiments of the present disclosure.

Various aspects of the present disclosure are described below as they might be employed in a drillable casing scraper. In the interest of clarity, not all features of an actual implementation are described in this specification. It will of course be appreciated that in the development of any such actual implementation, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Advantages of the various aspects of the present disclosure will become apparent from consideration of the following description and drawings. The following description and drawings may repeat reference numerals and/or letters in the various examples or figures. This repetition is for the purpose of simplicity and clarity and does not in itself dictate a relationship between the various embodiments and/or configurations discussed. Although a figure may depict a horizontal wellbore or a vertical wellbore, unless indicated otherwise, the various aspects of the present disclosure are equally well suited for use in wellbores having other orientations including vertical wellbores, horizontal wellbores, slanted wellbores, multilateral wellbores, or the like. Unless otherwise noted, even though a figure may depict an offshore operation, the various aspects of the present disclosure are equally well suited for use in onshore operations. Unless otherwise noted, even though a figure may depict a cased-hole wellbore, the various aspects of the present disclosure are equally well suited for use in open-hole wellbore operations.

Referring to FIG. 1, in an embodiment, an offshore oil and gas platform is schematically illustrated and generally referred to by the reference numeral 100. In an embodiment, the offshore oil and gas platform 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may include a hoisting apparatus 140, a derrick 145, a travel block 150, a hook 155, and a swivel 160, which components are together operable for raising and lowering a conveyance string 165.

The conveyance string 165 may be, include, or be part of, for example, a casing, a drill string, a completion string, a work string, a pipe joint, coiled tubing, production tubing, other types of pipe or tubing strings, and/or other types of conveyance vehicles, such as wireline, slickline, and/or the like. For example, the conveyance string 165 may be an axially extending tubular string made up of a plurality of pipe joints coupled to together end-to-end. The platform 105 may also include a kelly, a rotary table, a top drive unit, and/or other equipment associated with the rotation and/or translation of the conveyance string 165. A wellbore 170 extends from the subsea wellhead installation 130 and through the various earth strata, including the formation 110. At least a portion of the wellbore 170 includes a casing 175 cemented therein. The casing 175 includes an inner surface 176 to which debris may adhere over time.

A generally tubular downhole tool 180 is connected to the conveyance string 165 and extends within the wellbore 170. The downhole tool 180 includes a setting tool 185, an isolation tool 190 connected to the setting tool 185, and a casing scraper 195. Although described herein as part of the downhole tool 180, the casing scraper 195 may instead be deployed into the wellbore 170 as a standalone device for cleanout runs or integrated into a single-trip system in combination with other wellbore cleaning tools. The conveyance string 165 is adapted to convey the downhole tool 180 into the wellbore 170. In addition, or instead, the downhole tool 180 may be a "pumpdown" type tool adapted to be conveyed into the wellbore 170 by hydraulic pressure inside the casing 175 and above the downhole tool 180. The setting tool 185 may be, for example, an electric wireline, slickline, coiled tubing, mechanical, or hydraulic setting tool.

The isolation tool 190 is adapted to provide zonal isolation of the wellbore 170 so that a wellbore operation in which such isolation is required may be performed. In some embodiments, the isolation tool 190 is a frac plug used primarily between zones in multistage stimulation treatments, in which case the frac plug is adapted to isolate a lower zone during stimulation but to allow flow from below once the stimulation is over to aid in well cleanup. In some embodiments, the isolation tool 190 is a bridge plug that can be used in multistage stimulation treatments to provide isolation between zones or to provide a barrier for temporary abandonment or BOP change out. In some embodiments, the isolation tool 190 may be a packer such as, for example, a squeeze packer. In various embodiments, the isolation tool 190 may be any one of Halliburton's EZ Drill®, Fas Drill®, and/or Obsidian® plugs and packers.

Figure 2A:
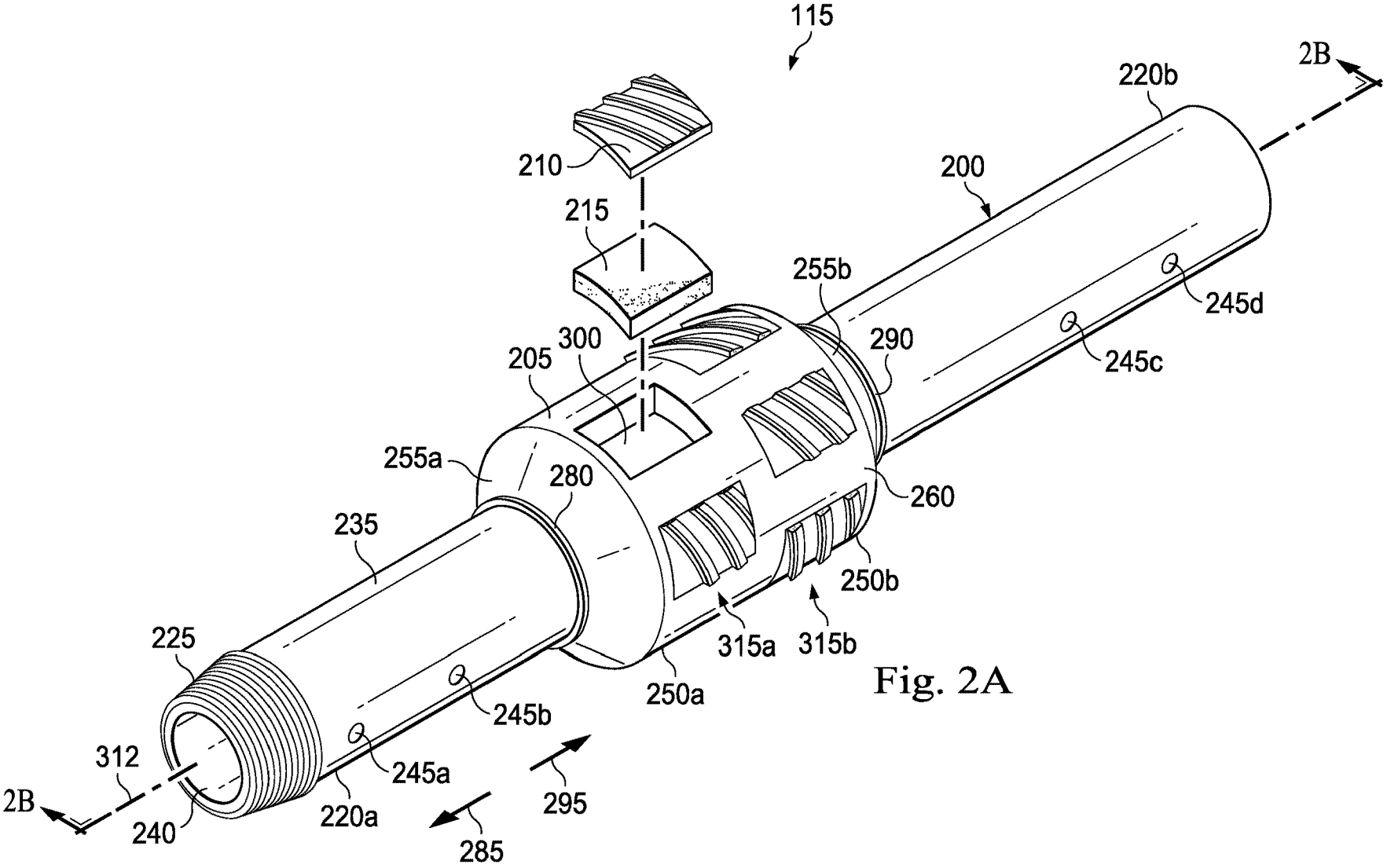
FIG. 2A is a perspective view of a portion of the downhole tool of FIG. 1 including a casing scraper, according to one or more embodiments of the present disclosure.
Figure 2B:
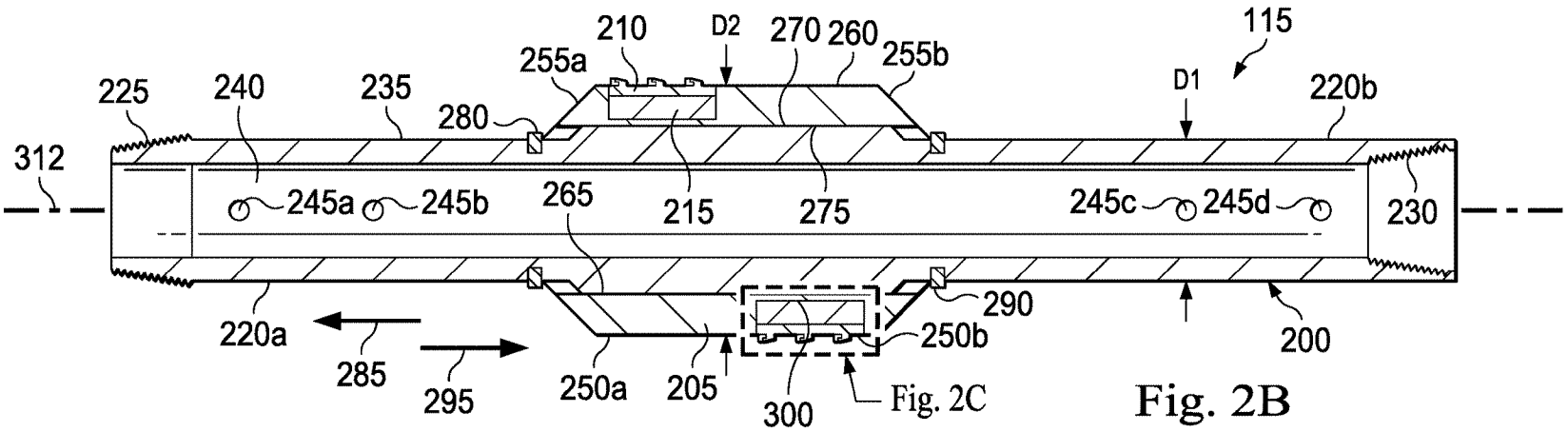
FIG. 2B is a cross-sectional view of the casing scraper of FIG. 2A, according to one or more embodiments of the present disclosure.
Figure 2C:
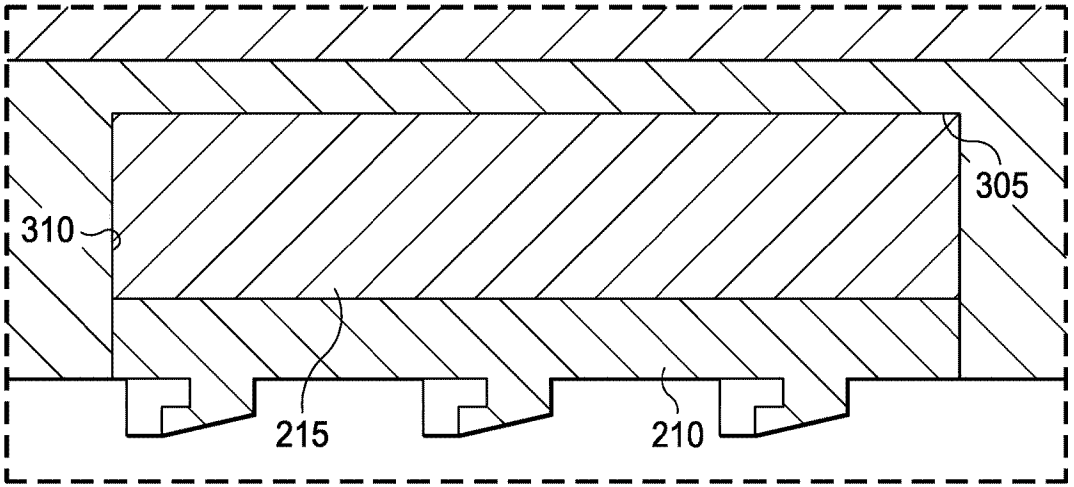

Referring to FIGS. 2A-2C, in an embodiment, the casing scraper 195 includes a base pipe 200, a mandrel 205, a plurality of scraper pads 210, and a plurality of spring pads 215. In some embodiments, the base pipe 200 is made of aluminum. The base pipe 200 is a generally tubular member including opposing end portions 220*a* and 220*b*. The end portion 220*a* includes a pin connection 225. The end portion 220*b* includes a box connection 230. In some embodiments, the pin connection 225 at the end portion 220*a* is replaced with a box connection substantially identical to the box connection 230. In some embodiments, the box connection 230 at the end portion 220*b* is replaced with a pin connection substantially identical to the pin connection 225. The base pipe 200 also includes an outer surface 235 and an internal passage 240 extending longitudinally therethrough from the end portion 220*a* to the end portion 220*b*. The outer surface 235 of the base pipe 200 defines an outside diameter D1. A pair of ports 245*a* and 245*b* extend from the internal passage 240 and through the outer surface 235 of the base pipe 200 at or near the end portion 220*a*. Similarly, a pair of ports 245*c* and 245*d* extend from the internal passage 240 and through the outer surface 235 of the base pipe 200 at or near the end portion 220*b*. In some embodiments, the ports 245*a-d* facilitate cementing of the casing scraper 195 into the casing 175 so that the casing scraper 195 may be subsequently drilled out.

The mandrel 205 includes opposing end portions 250*a* and 250*b*. A tapered outer surface 255*a* is formed in the mandrel 205 at the end portion 250*a*. Similarly, a tapered outer surface 255*b* is formed in the mandrel 205 at the end portion 250*b*. In some embodiments, the tapering of the outer surfaces 255*a* and 255*b* prevents, or at least reduces, the mandrel 205 from hanging on downhole restrictions. The mandrel 205 also includes an outer surface 260 that extends between the tapered outer surfaces 255*a* and 255*b*. The outer surface 260 defines an outside diameter D2. In some embodiments, the outside diameter D2 is greater than the outside diameter D1. In some embodiments, one of which is illustrated in FIG. 2B, the mandrel 205 is formed separately from the base pipe 200 and therefore includes an internal passage 265 extending longitudinally therethrough from the end portion 250*a* to the end portion 250*b*. In at least one such embodiment, as shown in FIG. 2B, the base pipe 200 includes an outer spline 270 and the mandrel 205 includes an inner spline 275 that matingly engages the outer spline 270 of the base pipe 200 to prevent, or at least reduce, relative rotation between the mandrel 205 and the base pipe 200.

In some embodiments, a retainer 280 engages both the base pipe 200 and the end portion 250*a* of the mandrel 205 to prevent, or at least reduce, movement of the mandrel 205 relative to the base pipe 200 in a direction 285. Similarly, in some embodiments, a retainer 290 engages both the base pipe 200 and the end portion 250*b* of the mandrel 205 to prevent, or at least reduce, movement of the mandrel 205 relative to the base pipe 200 in a direction 295, which is opposite the direction 285. The retainers 280 and 290 may be rings, clips, pins, screws, other types of retainers, or any combination thereof. In some embodiments, rather than being formed separately from the base pipe 200, the mandrel 205 is integrally formed with the base pipe 200.

Referring still to FIGS. 2A-2C, a plurality of pockets 300 are formed in the mandrel 205. The pockets 300 are rectangularly shaped. Alternatively, one or more of the pockets 300 may be triangularly shaped, pentagonally shaped, hexagonally shaped, circularly shaped, curved, polygonally shaped, or any combination thereof. The pockets 300 are each circumferentially staggered with respect to longitudinally adjacent ones of the pockets 300. In some embodiments, this circumferential staggering of the pockets 300 provides 360-degree coverage to ensure complete removal of debris adhering to the inner surface 176 of the casing 175. The pockets 300 may be arranged longitudinally in rows such as, for example, rows 315*a* and 315*b* shown in FIG. 2A. However, rather than being arranged longitudinally in rows, the pockets 300 may each be staggered longitudinally with respect to circumferentially adjacent ones of the pockets 300; in one such embodiment, the pockets 300 are spirally arranged.

In some embodiments, the scraper pads 210 are substantially identical to each other, the spring pads 215 are substantially identical to each other, and/or the pockets 300 are substantially identical to each other and, therefore, in connection with FIGS. 2A-2C, 3A-3C, and 4A-4B, only one of the scraper pads 210, only one of the spring pads 215, and only one of the pockets 300 will be described in detail below; however, the description below applies to every one of the scraper pads 210, the spring pads 215, and the pockets 300. Accordingly, as shown in FIGS. 2B-2C, the pocket 300 defines a bottom surface 305 and side surfaces 310 in the mandrel 205. The bottom surface 305 may be flat or curved; for example, the bottom surface 305 may be curved concentrically about a longitudinal axis 312 of the casing scraper 195. In some embodiments, the side surfaces 310 are each spaced in a substantially perpendicular relation with the bottom surface 305. The spring pad 215 is disposed within the pocket 300 between the scraper pad 210 and the mandrel 205. The scraper pad 210 also extends within the pocket 300. The scraper pad 210 and the spring pad 215 may be collectively referred to herein as a scraper module 316.

Figure 3A:
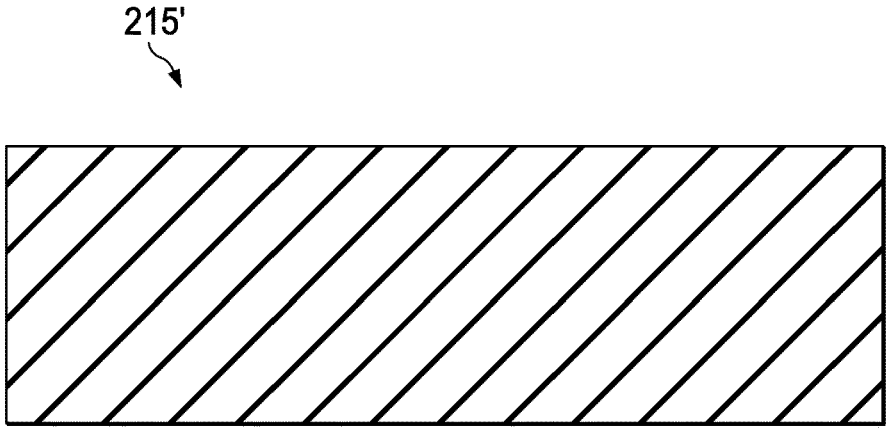
FIG. 3A is a cross-sectional view of a spring pad adapted to form part of the casing scraper of FIGS. 2A and 2B, according to one or more embodiments of the present disclosure.
Figure 3B:
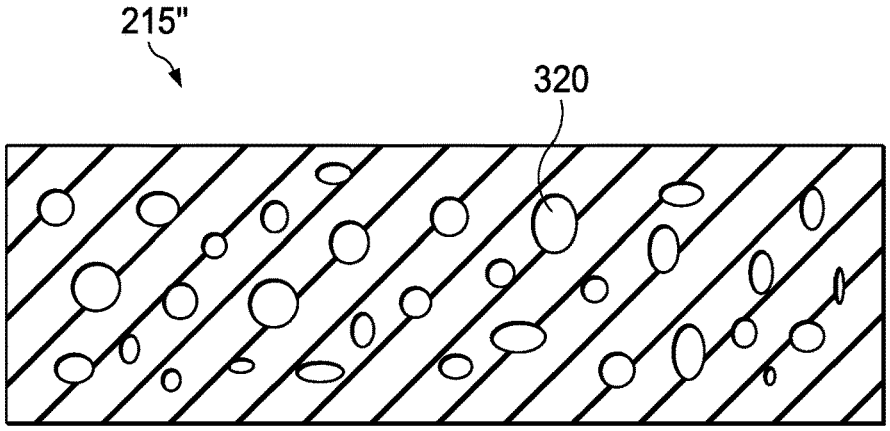
FIG. 3B is a cross-sectional view of another spring pad adapted to form part of the casing scraper of FIGS. 2A and 2B, according to one or more embodiments of the present disclosure.
Figure 3C:
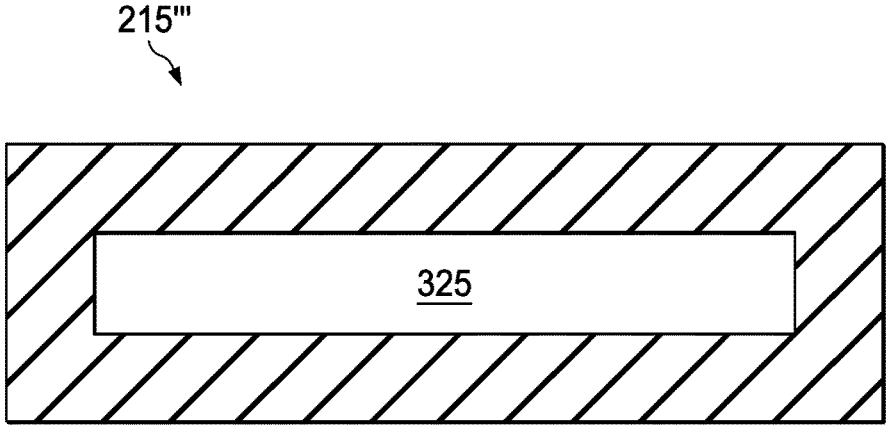
FIG. 3C is a cross-sectional view of yet another spring pad adapted to form part of the casing scraper of FIGS. 2A and 2B, according to one or more embodiments of the present disclosure.

Referring to FIGS. 3A-3C, in some embodiments, the spring pad 215 is made of an elastomeric material. In one such embodiment, as shown in FIG. 3A, the spring pad 215 is, includes, or is part of a spring pad 215' that is formed as a solid elastomer lacking any internal voids. In another such embodiment, as shown in FIG. 3B, the spring pad 215 is, includes, or is part of a spring pad 215" that is formed as an aerated elastomer having a plurality of internal voids 320. In yet another such embodiment, as shown in FIG. 3C, the spring pad 215 is, includes, or is part of a spring pad 215'" that is formed as a cell type elastomer pad having a sealed internal chamber 325. The sealed internal chamber 325 may be filled with air. In addition, or instead, the sealed internal chamber 325 may be filled with another fluid (e.g., a liquid or a gas).

Figure 4A:
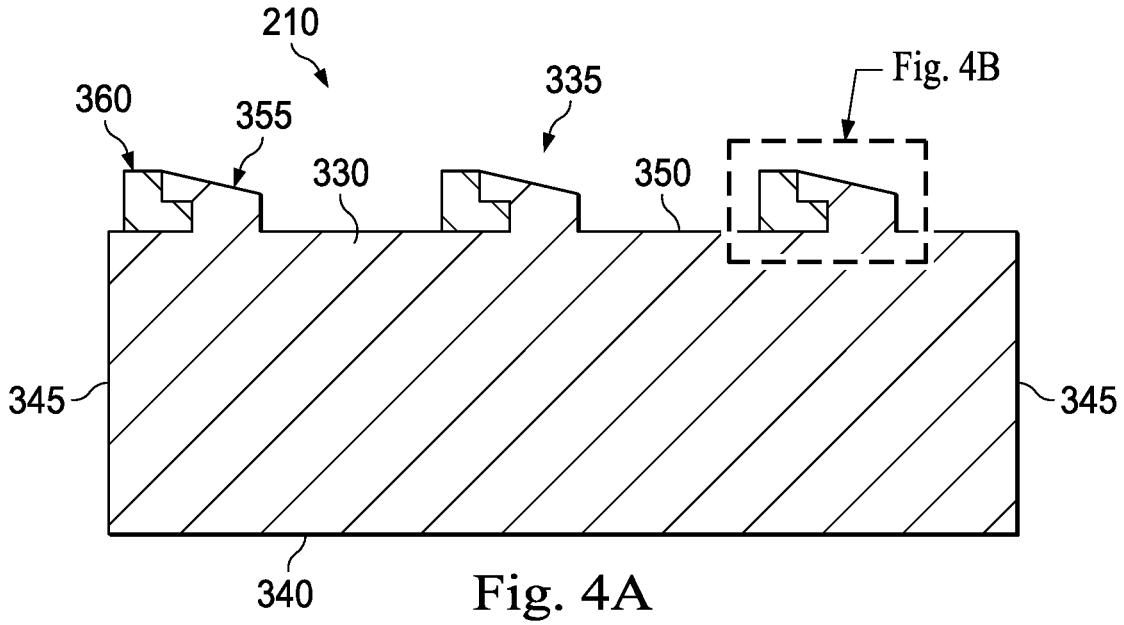
FIG. 4 is a cross-sectional view of a scraper pad adapted to form part of the casing scraper of FIGS. 2A and 2B, according to one or more embodiments of the present disclosure.
Figure 4B:
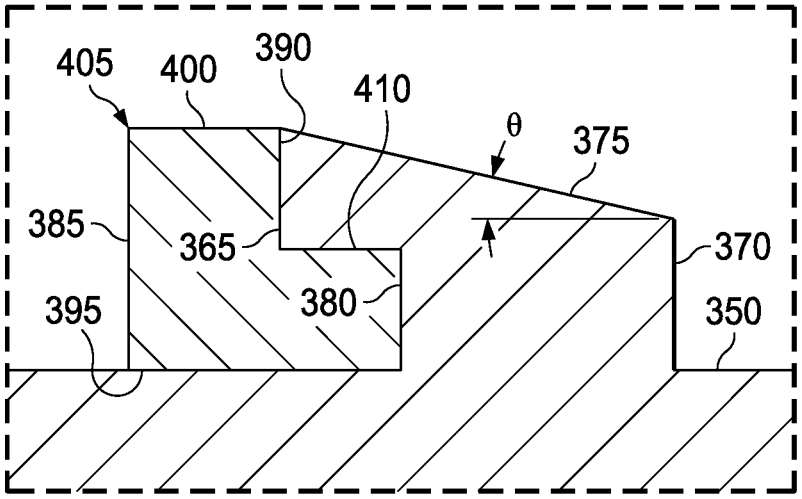

Referring to FIGS. 4A-4B, in an embodiment, the scraper pad 210 includes a pad body 330 and blades 335. The pad body 330 is sized and shaped to fit within the pockets 300. The pad body 330 includes a bottom surface 340, side surfaces 345, and a top surface 350. In some embodiments, the pad body 330 is made of aluminum. In some embodiments, the scraper pad 210 is positively retained in its pocket 300 by shoulders (not shown) machined into the side surfaces 310 of the pocket 300 and/or the side surfaces 345 of the pad body 330. In some embodiments, the bottom surface 340 of the pad body 330 is curved concentrically about the longitudinal axis 312 of the casing scraper 195. In some embodiments, the top surface 350 of the pad body 330 is curved concentrically about the longitudinal axis 312 of the casing scraper 195. In some embodiments, the side surfaces 345 of the pad body 330 are spaced in a substantially perpendicular relation with the bottom surface 340 and/or the top surface 350. In some embodiments, the top surface 350 of the pad body 330 is spaced in a substantially parallel relation with the bottom surface 340. In some embodiments, the blades 335 are angled spirally (shown in FIG. 2A) with respect to the longitudinal axis 312 of the casing scraper 195. The angling of the blades 335 spirally with respect to the longitudinal axis 312 of the casing scraper 195 prevents, or at least reduces, the blades 335 from hanging on downhole restrictions.

In some embodiments, as in FIG. 4A, the scraper pad 210 includes three of the blades 335. However, the scraper pad 210 may include any number of the blades 335 such as, for example, one, two, four, five, or more of the blades 335. In some embodiments, the blades 335 are substantially identical to each other and, therefore, in connection with FIG. 4B, only one of the blades 335 will be described in detail below; however, the description below applies to every one of the blades 335. Accordingly, as shown in FIG. 4B, the blade 335 includes a blade retainer 355 and a blade insert 360.

The blade retainer 355 is connected to, and extends from, the top surface 350 of the pad body 330. The blade retainer 355 includes a leading surface 365, a trailing surface 370, and an intermediate surface 375. In some embodiments, the blade retainer 355 is made of aluminum. In some embodiments, the leading surface 365 of the blade retainer 355 is spaced in a substantially perpendicular relation with the top surface 350 of the pad body 330. A groove 380 is formed in the leading surface 365 of the blade retainer 355 and adjacent the top surface 350 of the pad body 330. The intermediate surface 375 of the blade retainer 355 extends from the leading surface 365 to the trailing surface 370. In some embodiments, the trailing surface 370 of the blade retainer 355 is spaced in a substantially perpendicular relation with the top surface 350 of the pad body 330. In some embodiments, the intermediate surface 375 of the blade retainer 355 tapers inwardly at an angle $\ominus$ (relative to the top surface 350) from the leading surface 365 to the trailing surface 370 (i.e., the distance between the top surface 350 of the pad body 330 and the intermediate surface 375 is greater at the leading surface 365 than at the trailing surface 370). In some embodiments, the inward tapering of the intermediate surface 375 at the angle $\ominus$ prevents, or at least reduces, the blade 335 from hanging on downhole restrictions.

The blade insert 360 includes a leading surface 385, a trailing surface 390, an inner surface 395, and an outer surface 400. In some embodiments, the blade insert 360 is made of a metal-ceramic composite (MCC) material. In some embodiments, the leading surface 385 of the blade insert 360 is spaced in a substantially perpendicular relation with the inner surface 395 and/or the outer surface 400. In some embodiments, the trailing surface 390 of the blade insert 360 is spaced in a substantially perpendicular relation with the inner surface 395 and/or the outer surface 400. In some embodiments, the outer surface 400 of the blade insert 360 is spaced in a substantially parallel relation with the inner surface 395. The blade insert 360 includes a scraping edge 405 formed by the meeting of the leading surface 385 with the outer surface 400. The blade insert 360 also includes a tongue 410 extending from the trailing surface 390 and adjacent the inner surface 395. The tongue 410 is retained within the groove 380 of the blade retainer 355. The retaining of the tongue 410 within the groove 380 allows the scraping edge 405 of the blade insert 360 to remove debris adhering to the inner surface 176 of the casing 175. In some embodiments, the manner in which the tongue 410 is retained within the groove 380 of the blade retainer 355 causes: the inner surface 395 of the blade insert 360 to mate with the outer surface 350 of the blade retainer 355, the trailing surface 390 of the blade insert 360 to mate with the leading surface 365 of the blade retainer 355, and/or the outer surface 400 of the blade insert 360 to extend adjacent the intermediate surface 375 of the blade retainer 355.

Figure 5:
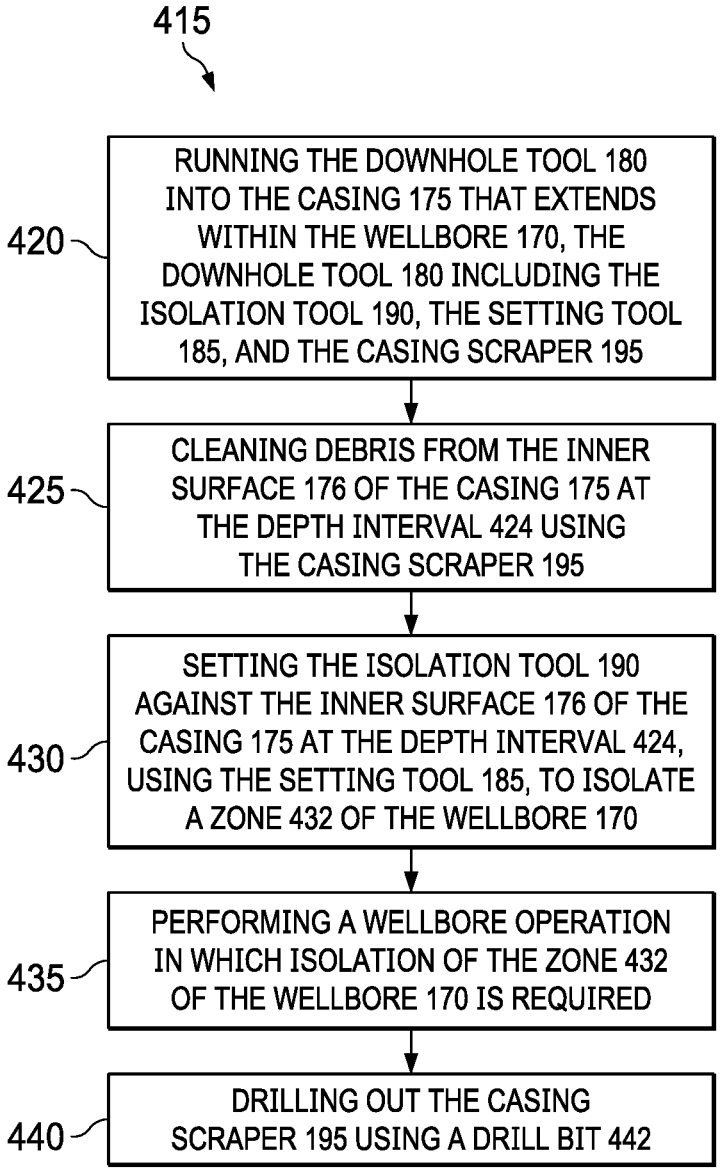
FIG. 5 is a flow diagram of a method for implementing one or more embodiments of the present disclosure.
Figure 6A:
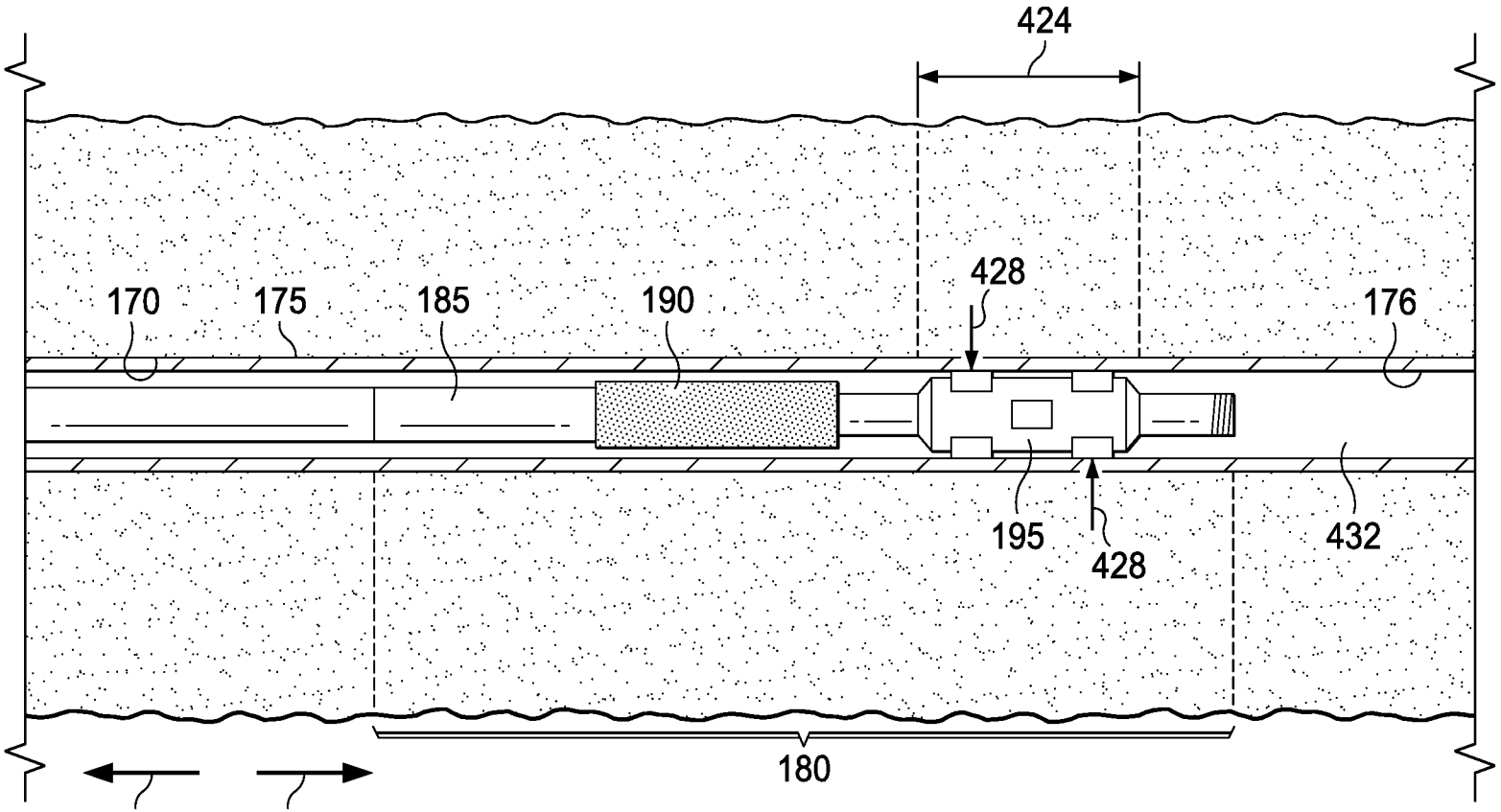
FIG. 6A is an elevational view illustrating at least one step of the method of FIG. 5, according to one or more embodiments of the present disclosure.
Figure 6B:
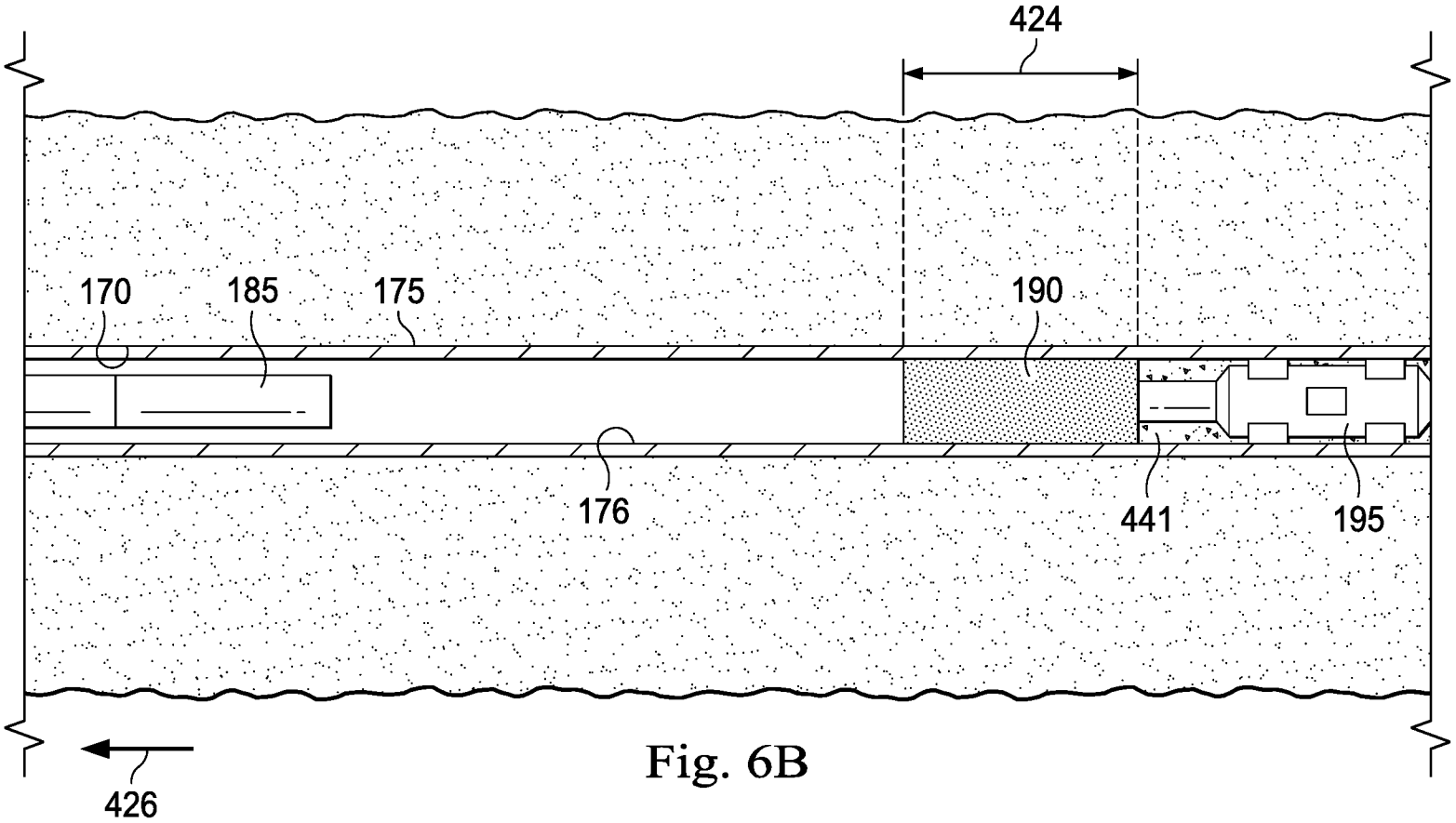
FIG. 6B is an elevational view illustrating at least another step of the method of FIG. 5, according to one or more embodiments of the present disclosure.
Figure 6C:
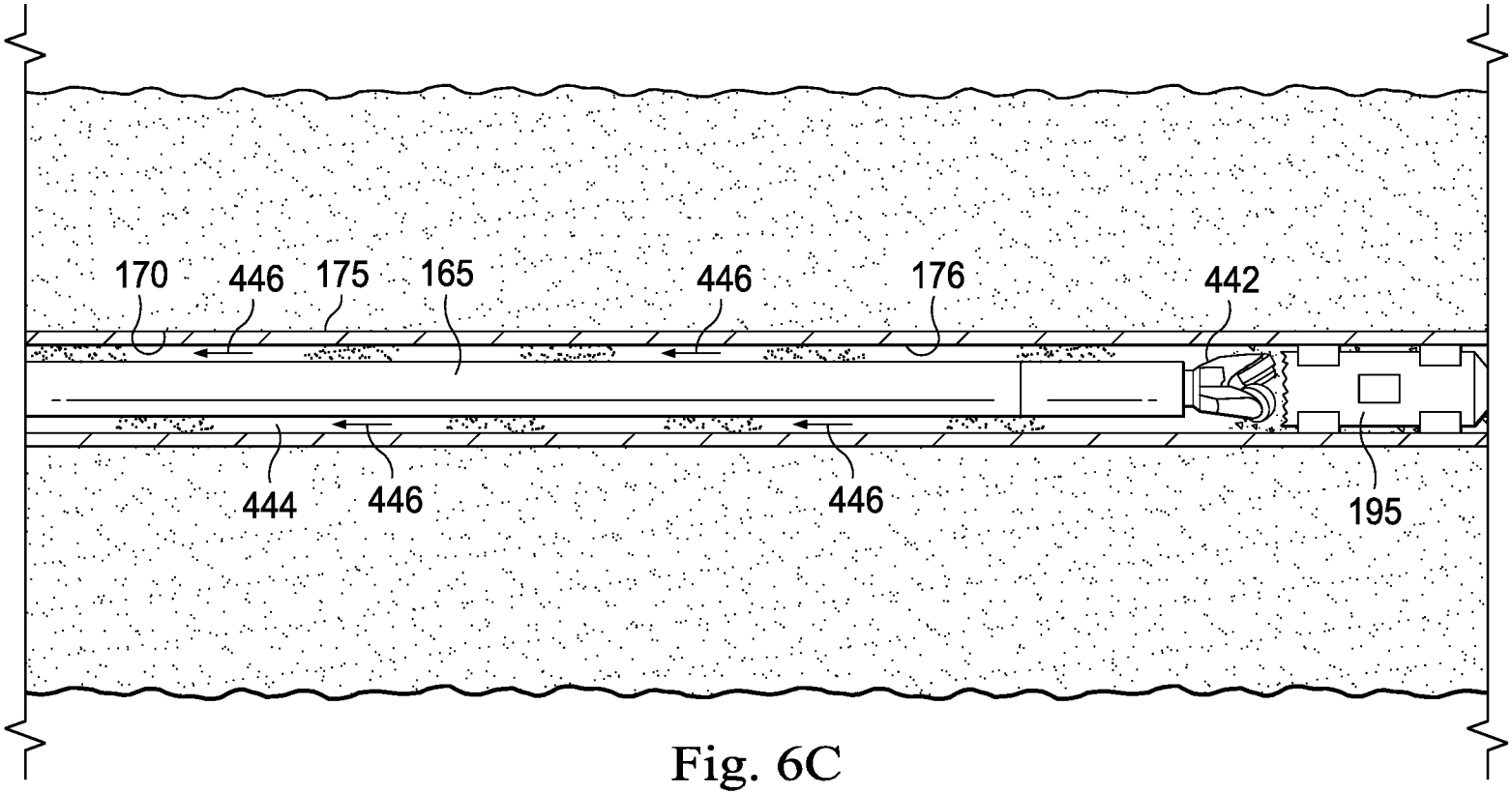
FIG. 6C is an elevational view illustrating at least yet another step of the method of FIG. 5, according to one or more embodiments of the present disclosure.

Referring to FIGS. 5 and 6A-C, in an embodiment, a method of operating the downhole tool 180 is diagrammatically illustrated and generally referred to by the reference numeral 415. In some embodiments, the downhole tool 180 and/or the method 415 reduce the number of trips required to effectively isolate the particular zone, to perform the wellbore operation, and to subsequently carry on another wellbore operation. The method 415 includes at a step 420 running the downhole tool 180 into the casing 175 that extends within the wellbore 170, the downhole tool 180 including the setting tool 185, the isolation tool 190, and the casing scraper 195, as shown in FIGS. 5 and 6A. At a step 425, debris is cleaned from the inner surface 176 of the casing 175 at the depth interval 424 using the casing scraper 195, as shown in FIGS. 5 and 6A. At a step 430, the isolation tool 190 is set against the inner surface 176 of the casing 175 at the depth interval 424 using the setting tool 185 to isolate a zone 432 of the wellbore 170, as shown in FIGS. 5 and 6B. At a step 435, a wellbore operation is performed in which isolation of the zone 432 of the wellbore 170 is required. Finally, at a step 440, the casing scraper 195 is drilled out using a drill bit 442, as shown in FIGS. 5 and 6C.

In some embodiments of the step 420, as in FIG. 6A, running the downhole tool 180 into the casing 175 includes displacing the downhole tool 180 in a downhole direction 422 until the casing scraper 195 reaches a depth interval 424. In some embodiments, the blade 335 is angled spirally (shown in FIG. 2A) relative to a longitudinal axis of the downhole tool 180 to prevent, or at least reduce, the blade 335 from hanging on downhole restrictions when the downhole tool 180 is run into the casing 175 in the downhole direction 422. In some embodiments, the blade retainer 355 includes the (tapered) intermediate surface 375 to prevent, or at least reduce, the blade retainer 355 from hanging on downhole restrictions when the downhole tool 180 is run into the casing 175 in the downhole direction 422. In some embodiments, the mandrel 205 includes the tapered outer surface 255*b* to prevent, or at least reduce, the mandrel 205 from hanging on downhole restrictions when the downhole tool 180 is run into the casing 175 in the downhole direction 422.

In some embodiments of the step 425, as in FIG. 6A, cleaning debris from the inner surface 176 of the casing 175 at the depth interval 424 includes displacing the downhole tool 180 in the downhole direction 422 so that the blade insert 360 scrapes against the inner surface 176 of the casing 175 at the depth interval 424. In other embodiments, however, the scraper pads 210 may be flipped so that cleaning debris from the inner surface 176 of the casing 175 at the depth interval 424 instead includes, after the casing scraper 195 reaches the depth interval 424, displacing the downhole tool 180 in an uphole direction 426 so that the blade insert 360 scrapes against the inner surface 176 of the casing 175 at the depth interval 424. In at least one such embodiment of the step 425, the casing scraper 195 is reciprocated back and forth in the uphole direction 426 and the downhole direction 422 to clean debris from the inner surface 176 of the casing 175. In at least one such embodiment of the step 425, cleaning debris from the inner surface 176 of the casing 175 at the depth interval 424 includes radially compressing the scraper module 316 between the mandrel 205 and the casing 175, as indicated by arrows 428 in FIG. 6A.

In some embodiments of the step 430, as in FIG. 6B, the setting tool 185 is retrieved from the wellbore 170 in the uphole direction 426 after the isolation tool 190 is set at the depth interval 424. In some embodiments, the blade retainer 355 includes the (tapered) intermediate surface 375 to prevent, or at least reduce, the blade retainer 355 from hanging on downhole restrictions when the downhole tool 180 is retrieved from the wellbore 170 in the uphole direction 426. In some embodiments, before, during, or after the step 430 of retrieving the setting tool 185 from the wellbore 170, the casing scraper 195 is cemented into the casing 175 via the ports 245*a-d*, as indicated by reference numeral 441 in FIG. 6B. In some embodiments, the step 430 is executed after the step 425 of cleaning the debris from the inner surface 176 of the casing 175 at the depth interval 424. As a result, the cleaning of the inner surface 176 of the casing 175 at the depth interval 424 at the step 425 improves the quality of the seal achieved between the isolation tool 190 and the casing 175 at the depth interval 424 at the step 430.

In some embodiments of the step 435, although shown below the isolation tool 190 in FIGS. 1 and 6A, the zone 432 of the wellbore 170 isolated by the isolation tool 190 may instead be located above the isolation tool 190, depending on the particular wellbore operation performed. In some embodiments, the step 435 is executed after the step 430 of setting the isolation tool 190 against the inner surface 176 of the casing 175 at the depth interval 424 to isolate the zone 432 of the wellbore 170.

In some embodiments of the step 440, as in FIG. 6C, prior to the drilling out of the casing scraper 195 using the drill bit 442, the drill bit 442 is run into the casing 175 in the downhole direction 422 using the conveyance string 165, or another conveyance string. In some embodiments of the step 440, prior to the drilling out of the casing scraper 195 using the drill bit 442, the casing scraper 195 is cemented into the casing 175 via the ports 245*a-d* so that the casing scraper 195 does not slide in the casing 195 during the drilling out operation, as indicated by the reference numeral 441 in FIG. 6B. In some embodiments, during the drilling out of the casing scraper 195 using the drill bit 442, the drill bit 442 is rotated and drilling fluid is communicated from the surface of the well downward through the conveyance string 165 and out through the drill bit 442 into the wellbore 170 to lubricate the drill bit 442 as it rotates. The drilling fluid (carrying drilled out particles of the casing scraper 195) then returns toward the surface of the well through an annulus 444 defined exterior to the conveyance string 165, as indicated by arrows 446 in FIG. 6C. In some embodiments, the casing scraper 195 is adapted to be drilled out with conventional tricone bits, polycrystalline diamond compact (PDC) bits, or junk-mill bits. In some embodiments of the step 440, at least one of the base pipe 200, the mandrel 205, or the scraper module 316 is or includes aluminum, which aluminum facilitates the drilling out of the downhole tool 180 by the drill bit 442. In some embodiments of the step 440, the blade insert 360 is or includes metal-ceramic composite (MCC) material, which MCC material facilitates the drilling out of the downhole tool 180 by the drill bit 442. In some embodiments of the step 440, the spring pad 215 is or includes an elastomeric material, which elastomeric material facilitates the drilling out of the downhole tool 180 by the drill bit 442.

A system has been disclosed. The system generally includes a downhole tool adapted to be run into a casing that extends within a wellbore, the downhole tool including an isolation tool, a setting tool, and a casing scraper, wherein the casing scraper is adapted to clean debris from an inner surface of the casing at a depth interval, wherein, after the casing scraper cleans the debris from the inner surface of the casing at the depth interval, the setting tool is adapted to set the isolation tool against the inner surface of the casing at the depth interval to isolate a zone of the wellbore, and wherein, after the setting tool sets the isolation tool against the inner surface of the casing at the depth interval to isolate the zone of the wellbore, a wellbore operation in which isolation of the zone of the wellbore is required is adapted to be performed; and a drill bit adapted to drill out the casing scraper after the wellbore operation is performed.

The foregoing system embodiment may include one or more of the following elements, either alone or in combination with one another:

The casing scraper includes: a base pipe, a mandrel extending around the base pipe and defining an outer surface, a pocket formed in the outer surface of the mandrel, and a scraper module extending within the pocket; and, to clean debris from the inner surface of the casing at the depth interval using the casing scraper, the scraper module is adapted to be radially compressed between the mandrel and the casing.

At least one of the base pipe, the mandrel, or the scraper module is or includes aluminum.

The scraper module includes a spring pad disposed within the pocket and a scraper pad extending within the pocket adjacent the spring pad, the scraper pad including: a pad body; and a blade including a blade retainer and a blade insert, the blade retainer extending from, and connected to, the pad body, and the blade insert being retained by the blade retainer.

The blade insert is or includes a metal-ceramic composite (MCC) material; or the spring pad is or includes an elastomeric material.

To run the downhole tool into the casing, the downhole tool is adapted to be displaced in a downhole direction until the casing scraper reaches the depth interval; and, to clean debris from the inner surface of the casing at the depth interval using the casing scraper, the downhole tool is adapted to be displaced in an uphole direction includes after the casing scraper reaches the depth interval so that the blade insert scrapes against the inner surface of the casing at the depth interval.

The blade retainer includes a tapered surface that prevents, or at least reduces, the blade retainer from hanging on downhole restrictions when the downhole tool is run into the casing in the downhole direction.

The blade is angled spirally relative to a longitudinal axis of the downhole tool to prevent, or at least reduce, the blade from hanging on downhole restrictions when the downhole tool is run into the casing in the downhole direction.

A method has also been disclosed. The method generally includes running a downhole tool into a casing that extends within a wellbore, the downhole tool including an isolation tool, a setting tool, and a casing scraper; cleaning, using the casing scraper, debris from an inner surface of the casing at a depth interval; after cleaning the debris from the inner surface of the casing at the depth interval, setting, using the setting tool, the isolation tool against the inner surface of the casing at the depth interval to isolate a zone of the wellbore; after setting the isolation tool against the inner surface of the casing at the depth interval to isolate the zone of the wellbore, performing a wellbore operation in which isolation of the zone of the wellbore is required; and drilling out the casing scraper using a drill bit.

The foregoing method embodiment may include one or more of the following elements, either alone or in combination with one another:

The casing scraper includes: a base pipe, a mandrel extending around the base pipe and defining an outer surface, a pocket formed in the outer surface of the mandrel, and a scraper module extending within the pocket; and cleaning debris from the inner surface of the casing at the depth interval includes radially compressing the scraper module between the mandrel and the casing.

At least one of the base pipe, the mandrel, or the scraper module is or includes aluminum.

The scraper module includes a spring pad disposed within the pocket and a scraper pad extending within the pocket adjacent the spring pad, the scraper pad including: a pad body; and a blade including a blade retainer and a blade insert, the blade retainer extending from, and connected to, the pad body, and the blade insert being retained by the blade retainer.

The blade insert is or includes a metal-ceramic composite (MCC) material; or the spring pad is or includes an elastomeric material.

Running the downhole tool into the casing includes displacing the downhole tool in a downhole direction until the casing scraper reaches the depth interval; and cleaning, using the casing scraper, debris from the inner surface of the casing at the depth interval includes, after the casing scraper reaches the depth interval, displacing the downhole tool in an uphole direction so that the blade insert scrapes against the inner surface of the casing at the depth interval.

The blade retainer includes a tapered surface that prevents, or at least reduces, the blade retainer from hanging on downhole restrictions when the downhole tool is run into the casing in the downhole direction.

The blade is angled spirally relative to a longitudinal axis of the downhole tool to prevent, or at least reduce, the blade from hanging on downhole restrictions when the downhole tool is run into the casing in the downhole direction.

An apparatus adapted to clean debris from an inner surface of a casing that extends within a wellbore has also been disclosed. The apparatus generally includes a spring pad adapted to be disposed within a pocket formed in an outer surface of a downhole tool; and a scraper pad adapted to extend within the pocket adjacent the spring pad, the scraper pad including: a pad body; and a blade including a blade retainer and a blade insert, the blade retainer extending from, and being connected to, the pad body, and the blade insert being retained by the blade retainer; wherein, to clean debris from the inner surface of the casing, the apparatus is adapted to be radially compressed in the pocket between the downhole tool and the casing.

The foregoing apparatus embodiment may include one or more of the following elements, either alone or in combination with one another:

The blade insert is or includes a metal-ceramic composite (MCC) material; or the spring pad is or includes an elastomeric material.

The blade retainer includes a tapered surface that prevents, or at least reduces, the blade retainer from hanging on downhole restrictions when the downhole tool is run into the casing in a downhole direction.

The blade is angled spirally relative to a longitudinal axis of the downhole tool to prevent, or at least reduce, the blade from hanging on downhole restrictions when the downhole tool is run into the casing in a downhole direction.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down,"

etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

running a downhole tool into a casing that extends within a wellbore, the downhole tool comprising an isolation tool, a setting tool, and a casing scraper;

cleaning, using the casing scraper, debris from an inner surface of the casing at a depth interval;

after cleaning the debris from the inner surface of the casing at the depth interval, setting, using the setting tool, the isolation tool against the inner surface of the casing at the depth interval to isolate a zone of the wellbore;

after setting the isolation tool against the inner surface of the casing at the depth interval to isolate the zone of the wellbore, performing a wellbore operation; and drilling out the casing scraper using a drill bit.

2. The method of claim 1, wherein the casing scraper comprises:

a base pipe;

a mandrel extending around the base pipe and defining an outer surface;

a pocket formed in the outer surface of the mandrel; and a scraper module extending within the pocket;

and wherein cleaning debris from the inner surface of the casing at the depth interval comprises radially compressing the scraper module between the mandrel and the casing.

3. The method of claim 2, wherein at least one of the base pipe, the mandrel, or the scraper module is or includes aluminum.

4. The method of claim 2, wherein the scraper module comprises:

a spring pad disposed within the pocket; and a scraper pad extending within the pocket adjacent the spring pad, the scraper pad comprising:

a pad body; and a blade comprising a blade retainer and a blade insert, the blade retainer extending from, and connected to, the pad body, and the blade insert being retained by the blade retainer.

5. The method of claim 4, wherein:

the blade insert is or includes a metal-ceramic composite (MCC) material; or the spring pad is or includes an elastomeric material.

6. The method of claim 4, wherein running the downhole tool into the casing comprises displacing the downhole tool in a downhole direction until the casing scraper reaches the depth interval; and wherein cleaning, using the casing scraper, debris from the inner surface of the casing at the depth interval comprises, after the casing scraper reaches the depth interval, displacing the downhole tool in an uphole direction so that the blade insert scrapes against the inner surface of the casing at the depth interval.

7. The method of claim 6, wherein the blade retainer includes a tapered surface that prevents, or at least reduces, the blade retainer from hanging on downhole restrictions when the downhole tool is run into the casing in the downhole direction.

8. The method of claim 6, wherein the blade is angled spirally relative to a longitudinal axis of the downhole tool to prevent, or at least reduce, the blade from hanging on downhole restrictions when the downhole tool is run into the casing in the downhole direction.

9. A system, comprising:

a downhole tool adapted to be run into a casing that extends within a wellbore, the downhole tool comprising an isolation tool, a setting tool, and a casing scraper, wherein the casing scraper is adapted to clean debris from an inner surface of the casing at a depth interval, wherein, after the casing scraper cleans the debris from the inner surface of the casing at the depth interval, the setting tool is adapted to set the isolation tool against the inner surface of the casing at the depth interval to isolate a zone of the wellbore, and wherein, after the setting tool sets the isolation tool against the inner surface of the casing at the depth interval to isolate the zone of the wellbore, a wellbore operation is performed;

and a drill bit adapted to drill out the casing scraper after the wellbore operation is performed.

10. The system of claim 9, wherein the casing scraper comprises:

a base pipe;

a mandrel extending around the base pipe and defining an outer surface;

a pocket formed in the outer surface of the mandrel; and a scraper module extending within the pocket;

and wherein, to clean debris from the inner surface of the casing at the depth interval using the casing scraper, the scraper module is adapted to be radially compressed between the mandrel and the casing.

11. The system of claim 10, wherein at least one of the base pipe, the mandrel, or the scraper module is or includes aluminum.

12. The system of claim 10, wherein the scraper module comprises:

a spring pad disposed within the pocket; and a scraper pad extending within the pocket adjacent the spring pad, the scraper pad comprising:

a pad body; and a blade comprising a blade retainer and a blade insert, the blade retainer extending from, and connected to, the pad body, and the blade insert being retained by the blade retainer.

13. The system of claim 12, wherein:

the blade insert is or includes a metal-ceramic composite (MCC) material; or the spring pad is or includes an elastomeric material.

14. The system of claim 12, wherein, to run the downhole tool into the casing, the downhole tool is adapted to be displaced in a downhole direction until the casing scraper reaches the depth interval; and wherein, to clean debris from the inner surface of the casing at the depth interval using the casing scraper, the downhole tool is adapted to be displaced in an uphole direction comprises after the casing scraper reaches the depth interval so that the blade insert scrapes against the inner surface of the casing at the depth interval.

15. The system of claim 14, wherein the blade retainer includes a tapered surface that prevents, or at least reduces, the blade retainer from hanging on downhole restrictions when the downhole tool is run into the casing in the downhole direction.

16. The system of claim 14, wherein the blade is angled spirally relative to a longitudinal axis of the downhole tool to prevent, or at least reduce, the blade from hanging on downhole restrictions when the downhole tool is run into the casing in the downhole direction.

17. An apparatus adapted to clean debris from an inner surface of a casing that extends within a wellbore, the apparatus comprising:

a setting tool used to set an isolation tool against the inner surface of the casing at a depth interval to isolate a zone of the wellbore;

a spring pad adapted to be disposed within a pocket formed in an outer surface of a downhole tool; and a scraper pad adapted to extend within the pocket adjacent the spring pad, the scraper pad comprising:

a pad body; and a blade comprising a blade retainer and a blade insert, the blade retainer extending from, and being connected to, the pad body, and the blade insert being retained by the blade retainer;

wherein, to clean debris from the inner surface of the casing, the apparatus is adapted to be radially compressed in the pocket between the downhole tool and the casing; and wherein, the scraper pad and spring pad are adapted to be drilled out after isolating the zone using the isolation tool and performing a wellbore operation.

18. The apparatus of claim 17, wherein:

the blade insert is or includes a metal-ceramic composite (MCC) material; or the spring pad is or includes an elastomeric material.

19. The apparatus of claim 17, wherein the blade retainer includes a tapered surface that prevents, or at least reduces, the blade retainer from hanging on downhole restrictions when the downhole tool is run into the casing in a downhole direction.

20. The apparatus of claim 17, wherein the blade is angled spirally relative to a longitudinal axis of the downhole tool to prevent, or at least reduce, the blade from hanging on downhole restrictions when the downhole tool is run into the casing in a downhole direction.

* * * * *